US011236617B2

(12) United States Patent
Flamme et al.

(10) Patent No.: US 11,236,617 B2
(45) Date of Patent: Feb. 1, 2022

(54) BLADE COMPRISING AN IMPROVED COOLING CIRCUIT

(71) Applicant: SAFRAN, Paris (FR)

(72) Inventors: Thomas Michel Flamme, Moissy-Cramayel (FR); Romain Pierre Cariou, Moissy-Cramayel (FR); Sylvain Paquin, Moissy-Cramayel (FR); Adrien Bernard Vincent Rollinger, Moissy-Cramayel (FR)

(73) Assignee: SAFRAN, Paris (FR)

( * ) Notice: Subject to any disclaimer, the term of this patent is extended or adjusted under 35 U.S.C. 154(b) by 164 days.

(21) Appl. No.: 16/604,089

(22) PCT Filed: Apr. 10, 2018

(86) PCT No.: PCT/FR2018/000079
§ 371 (c)(1),
(2) Date: Oct. 9, 2019

(87) PCT Pub. No.: WO2018/189432
PCT Pub. Date: Oct. 18, 2018

(65) Prior Publication Data

US 2020/0149405 A1 May 14, 2020

(30) Foreign Application Priority Data

Apr. 10, 2017 (FR) ..... 1700388

(51) Int. Cl.
*F01D 5/18* (2006.01)

(52) U.S. Cl.
CPC ..... *F01D 5/18* (2013.01); *F01D 5/187* (2013.01); *F05D 2250/185* (2013.01)

(58) Field of Classification Search
CPC ..... F01D 5/187
See application file for complete search history.

(56) References Cited

U.S. PATENT DOCUMENTS 5,356,265 A * 10/1994 Kercher ..... F01D 5/187 416/97 R
6,126,396 A * 10/2000 Doughty ..... F01D 5/20 416/97 R (Continued)

FOREIGN PATENT DOCUMENTS

CN 1982655 A 6/2007
CN 1995708 A 7/2007

(Continued)

OTHER PUBLICATIONS

International Search Report and Written Opinion dated Sep. 13, 2018, in International Application No. PCT/FR2018/000079 (9 pages).

(Continued)

*Primary Examiner* — Justin D Seabe
(74) *Attorney, Agent, or Firm* — Bookoff McAndrews, PLLC

(57) ABSTRACT

Blade for a turbine, comprising a blade root and an airfoil (13) extending radially outwards from the blade root (12), the airfoil (13) comprising a first internal cooling circuit including an intrados cavity (33, 36) extending radially along the intrados wall (16) and a first inner wall (47, 45) arranged between the intrados wall (16) and the extrados wall (18), an extrados cavity (34, 37) extending radially along the extrados wall (18) and a second inner wall (47, 43) arranged between the intrados wall (16) and the extrados wall (18). The first cooling circuit includes one inner through cavity (35, 38) defined between two through walls (59, 57, 55, 53) each extending between the intrados wall (16) and the extrados wall (18). The intrados cavity (33, 36), the extrados cavity (34, 37) and the inner through cavity (35, 38) are fluidly connected in series.

12 Claims, 7 Drawing Sheets

(56) References Cited

U.S. PATENT DOCUMENTS

| | | | | |
|---|---|---|---|---|
| 7,611,330 | B1 * | 11/2009 | Liang | F01D 5/187 416/97 R |
| 7,661,930 | B2 * | 2/2010 | Deschamps | F01D 5/187 416/97 R |
| 8,066,483 | B1 | 11/2011 | Liang | |
| 8,944,763 | B2 * | 2/2015 | Lee | F01D 5/187 416/97 R |
| 9,022,736 | B2 * | 5/2015 | Lee | F01D 5/187 416/97 R |
| 10,641,100 | B2 * | 5/2020 | Auxier | F01D 5/187 |

FOREIGN PATENT DOCUMENTS

| | | | |
|---|---|---|---|
| CN | 105164376 | A | 12/2015 |
| EP | 0661414 | A1 | 7/1995 |
| EP | 1526250 | A2 | 4/2005 |
| EP | 1584790 | A2 | 10/2005 |
| RU | 1287678 | A2 | 2/1997 |
| RU | 2285129 | C2 | 10/2006 |
| WO | WO 2015162389 | A1 | 10/2015 |

OTHER PUBLICATIONS

Office Action issued in Chinese Patent Application No. 201880033186.7, dated Oct. 22, 2021 (8 pages).
Search Report issued in Russian Patent Application No. 2019135909, dated Nov. 12, 2021 (5 pages).

* cited by examiner

BLADE COMPRISING AN IMPROVED COOLING CIRCUIT

CROSS-REFERENCE TO RELATED APPLICATIONS

This application is the U.S. national phase entry under 35 U.S.C. § 371 of International Application No. PCT/FR2018/000079, filed on Apr. 10, 2018, which claims priority to French Patent Application No. 1700388, filed on Apr. 10, 2017.

FIELD OF THE INVENTION

The present disclosure relates to a blade, for example a blade for a turbine that can be used within an aircraft turbomachine, and more particularly to the internal cooling of such a blade.

TECHNOLOGICAL BACKGROUND

An aircraft turbomachine usually comprises a combustion chamber whose combustion gases rotatably drive one or more turbines. To protect the turbine blades from the high temperatures to which they are thus subjected, particularly the movable blades, it is known to provide that the blades are hollow so as to make a coolant, for example relatively cold air taken upstream of the combustion chamber, circulate inside the blades.

The international application WO 2015/162389 A1 of the Applicant describes a blade for a turbomachine turbine comprising a cooling circuit with improved homogeneity. Particularly, this blade includes several cavities within the thickness of the airfoil.

However, the increased performance requirements lead to an increase of the efficiency of the turbomachine, and consequently to an increase of the temperature of the combustion gases passing through the turbines without increasing the flow rate of the coolant inside the blades. Thus, although the aforementioned blade has satisfactory results, there is a need for a blade that is even more resistant to high temperatures.

PRESENTATION OF THE INVENTION

For this purpose, the present disclosure relates to a blade for a turbine, comprising a blade root defining a radially inner end of the blade and an airfoil extending radially outwards from the blade root and having an intrados wall and an extrados wall connected to the intrados wall at a leading edge and a trailing edge of the airfoil, the airfoil comprising at least a first internal cooling circuit including at least one intrados cavity extending radially along the intrados wall and along a first inner wall arranged between the intrados wall and the extrados wall, at least one extrados cavity extending radially along the extrados wall and along a second inner wall, arranged between the intrados wall and the extrados wall, the blade being characterized in that the first cooling circuit further includes at least one inner through cavity defined between two through walls each extending between the intrados wall and the extrados wall, away from the leading edge and from the trailing edge, the inner through cavity extending radially along the intrados wall and the extrados wall, wherein the intrados cavity, the extrados cavity and the inner through cavity are fluidly connected in series.

In the present disclosure, unless otherwise stated, the upstream and the downstream are defined with respect to the normal direction of flow of the gas (from upstream to downstream) through the turbomachine. The upstream and the downstream are expressed in relation to the gas circulating outside the blade, generally from the leading edge toward the trailing edge, and not in relation to the coolant (cooling fluid) circulating inside the blade. For the sake of conciseness and without loss of generality, the terms coolant or more simply air will be used thereafter indifferently.

Furthermore, the axis of the turbine stands for the axis of rotation of the rotor of the turbine. The axial direction corresponds to the direction of the axis of the turbine and a radial direction, along which the airfoil extends, is a direction perpendicular to this axis and intersecting this axis. Thus, the radial direction corresponds to the longitudinal direction of the airfoil. Similarly, an axial plane is a plane containing the axis of the turbine and a radial plane is a plane perpendicular to this axis. A transverse plane is a plane orthogonal to the radial or longitudinal direction. A circumference is expressed as a circle belonging to a radial plane and whose center belongs to the axis of the turbine. A tangential or circumferential direction is a direction tangent to a circumference; it is perpendicular to the axis of the compressor but does not pass through the axis.

Within the meaning of the present disclosure, a cavity extends radially along a wall if the cavity is adjacent to the wall over at least half its length, preferably substantially its entire length, in a radial direction. Moreover, a cavity is considered as distinct from another cavity if these two cavities are separated by a wall over at least half the length of the airfoil in a radial direction, preferably substantially the entire length of the airfoil.

Thanks to the presence of the inner through cavity as defined above, the through walls have a freedom of deformation to accommodate the differential expansion between the outer portions of the blade, such as the relatively hot intrados and extrados walls, and the inner portions of the blade, such as the relatively cold first and second inner walls. Thus, the internal structure of the blade is made more flexible, which limits the appearance of stresses in the blade and, consequently, increases its resistance to temperature differences and its longevity. The fact that the intrados cavity, the extrados cavity and the inner through cavity are fluidly connected in series also makes it possible to maximize the work of the coolant and to homogenize the temperature inside the blade, which also contributes to the reduction of the stresses in the blade.

The second inner wall may be distinct or merged (coincident) with the first inner wall. In the case where the second inner wall is merged with the first inner wall, the intrados cavity and the extrados cavity are adjacent. In these embodiments, the direction of circulation of the cooling air can be reversed, between the intrados cavity and the extrados cavity, within the thickness of the airfoil. The thickness of the airfoil indicates a direction perpendicular to a mean line between the intrados wall and the extrados wall, in a transverse plane.

In addition, the first inner wall and the second inner wall may be each connected to one of said through walls; the first and second inner walls can then be connected to the same through walls or to distinct through walls.

In some embodiments, the intrados cavity, the extrados cavity and the inner through cavity are fluidly connected in this order. Connecting said cavities in the order mentioned above makes it possible to further optimize the work of air for a movable blade. Indeed, because of the rotation of the blade assembly, the Coriolis force presses the cooling air along the intrados or extrados walls of the blade, depending on whether the air stream is ascending or descending inside the airfoil. The aforementioned order makes it possible to press the air against the intrados wall in the intrados cavity and against the extrados wall in the extrados cavity, then again against the intrados wall in the inner through cavity. Thus, the interaction of the air with the intrados and extrados walls is maximized while the interaction of the air with the inner walls is limited, which makes it possible to respectively and concomitantly improve the cooling of the intrados and extrados walls and to limit the thermal gradient within the blade, between the intrados and extrados walls on the one hand and the inner walls on the other hand. In addition, as it will be detailed by the following, the mechanical properties of the intrados wall, of the extrados wall and of the inner walls may depend on the temperature; particularly, the mechanical properties can be substantially constant up to a threshold temperature, and then gradually deteriorate above the threshold temperature. Thus, it is useless to cool down the inner walls below the threshold temperature.

In some embodiments, the intrados cavity and/or the extrados cavity has a cross-section decreasing in the radial direction. Preferably, the intrados cavity may have a cross-section decreasing from the radially inner end of the airfoil towards the radially outer end of the airfoil. Alternatively or in addition, the extrados cavity may have a cross-section decreasing from the radially outer end of the airfoil towards the radially inner end of the airfoil. The fact that the intrados and/or extrados cavities are radially convergent improves the flow in the cavities and makes it possible to limit, if not avoid, the recirculating vortices. In addition, when an intrados cavity and an extrados cavity are adjacent on either side of the same inner wall, tilting the inner wall which separates them, with respect to the radial direction, makes it possible to obtain the aforementioned configuration in a structurally simple manner, and whether these cavities are in fluid communication or not. Furthermore, this configuration is facilitated by the limited interaction of air with the inner walls, particularly when the air is pressed against the intrados wall in the intrados cavity and against the extrados wall in the extrados cavity.

In some embodiments, the first inner wall is connected to a first one of said through walls and the second inner wall is connected to a second one of said through walls. The first through wall is distinct from the second through wall. This implies that the first inner wall and the second inner wall are distinct. The intrados and extrados cavities are thus arranged on either side of the inner through cavity.

In some embodiments, the blade comprises a third through wall connected to the first inner wall or to the second inner wall, the internal cooling circuit including a second through cavity extending radially along the intrados wall, the extrados wall and the third through wall. The second through cavity may be internal, that is to say extend away from the leading edge or from the trailing edge, or be defined between the third through wall and the intrados and extrados walls joining at the leading edge or at the trailing edge. The presence of the second through cavity allows making the internal structure of the blade more flexible.

In some embodiments, the third through wall being connected to the first inner wall (respectively to the second inner wall), the intrados cavity (respectively extrados cavity) is adjacent to the first through cavity and to the second through cavity. Thus, the first and second through cavities may be provided on either side of the intrados cavity (respectively extrados cavity). In these embodiments, the first and second through cavities are separated by a single intrados cavity (respectively extrados cavity) which extends radially along the first through cavity, the second through cavity, the first inner wall (respectively the second inner wall) and the intrados wall (respectively the extrados wall).

In some embodiments, the intrados cavity and the extrados cavity are arranged on either side of the inner through cavity and a passage fluidly connects the intrados cavity to the extrados cavity without passing through the inner through cavity. The extrados cavity can, in turn, be fluidly connected to the inner through cavity. In these embodiments, the intrados cavity, the extrados cavity and the inner through cavity are arranged in the form of a trombone winding onto itself. Said passage is preferably located at the radially outer end of the airfoil.

In some embodiments, the intrados cavity is arranged on the trailing edge side and the extrados cavity is arranged on the leading edge side with respect to the inner through cavity. Thus, the cooling air circulates, between the intrados cavity and the extrados cavity, from the trailing edge toward the leading edge that is to say in counter-flow to the air driving the turbine. The relatively fresh cooling air can possibly be discharged from the airfoil on the leading edge side, where it flows downstream along the airfoil and forms a protective cooling layer of cooling by a fluid film which will be described later.

In some embodiments, the first inner wall and the second inner wall are each delimited by two through walls, each through wall extending between the intrados wall and the extrados wall. Each inner wall delimited by two through walls can define an internal structure in a general H shape. Thus, in these embodiments, the blade comprises an internal structure in a general double H shape, the side bars being the through walls. It is possible, similarly, to envisage an internal structure in a general triple H shape, or quadruple H shape or more, with as many inner walls and through walls as necessary. Two successive through walls, if they are not connected by the first or second inner wall, can be separated by the above-mentioned inner through cavity.

In some embodiments, the intrados wall has at least one orifice, preferably a plurality of orifices, connecting the inner through cavity to the outside of the airfoil. This orifice may serve, possibly in combination with other similar or different orifices, as air outlet for the inner through cavity. The orifice makes it possible to discharge, along the intrados wall, the air that has circulated in the inner through cavity. It thus forms a protective layer of cooling by a fluid film, better known as "film-cooling", which contributes to reducing not only the temperature of the intrados wall but also the heating of the cooling air in the cavities, which proves to be particularly advantageous when the intrados cavity is located on the trailing edge side relative to the inner through cavity. Optionally, the orifice can be directed towards the trailing edge, which improves the uniformity of the air stream and reinforces the protective layer.

In some embodiments, the blade comprises a second internal cooling circuit identical to the internal cooling circuit, in particular wherein the first inner wall of the first internal cooling circuit is merged with the second inner wall of the second internal cooling circuit.

By "identical", it is understood that the second internal cooling circuit may comprise at least one intrados cavity extending radially along the intrados wall and a first inner wall arranged between the intrados wall and the extrados wall, at least one extrados cavity extending radially along the extrados wall and a second inner wall, arranged between the intrados wall and the extrados wall, the second cooling circuit may further include at least one inner through cavity defined between two through walls each extending between the intrados wall and the extrados wall, away from the leading edge and from the trailing edge, the inner through cavity extending radially along the intrados wall and the extrados wall, wherein the intrados cavity, the extrados cavity and the inner through cavity are fluidly connected in series. Optionally, the second internal cooling circuit may have all or some of the other detailed features about the first internal cooling circuit.

Moreover, this configuration can be provided on a recurrent basis: thus, some embodiments comprise a third internal cooling circuit identical to the second internal cooling circuit, in particular wherein the first inner wall of the second internal cooling circuit is merged with the second inner wall of the third internal cooling circuit. In this way, several other internal cooling circuits may be provided according to the same scheme.

In some embodiments, the blade comprises a tub at its radially outer end, and the first internal cooling circuit comprises an auxiliary extrados cavity extending radially along the extrados wall and configured to supply a cooling cavity of the tub, generally disposed under the tub. A tub is a cavity located in the tip of the blade, that is to say at its radially outer end, open towards said end and delimited by a bottom wall and a flange, said flange extending between the leading edge and the trailing edge. The cooling cavity of the tub is intended to improve the cooling at the airfoil tip, which is a traditionally hot spot of the blade in operation, difficult to cool and having a limited lifetime.

In some embodiments, the airfoil comprises a leading edge cooling circuit comprising an upstream cavity extending radially along the intrados wall and the extrados wall and adjacent to the leading edge, and a first supply cavity fluidly connected to the upstream cavity for its supply with cooling air. Thanks to the fact that the supply of the upstream cavity is indirect, via the first supply cavity, still relatively fresh air, having worked little, can be provided up to the radially outer end of the upstream cavity, which improves the cooling at the leading edge at the airfoil tip. The fluid connection between the upstream cavity and the first supply cavity can be achieved by an impact device. Such an impact device may comprise a plurality of channels. These channels may be of small section relative to the size of the cavity and/or disposed substantially radially. These channels can be configured to accelerate the air passing therethrough, so as to form a jet that impacts the facing wall, here the wall of the upstream cavity, and thus locally improve the heat exchanges.

In some embodiments, the airfoil comprises a trailing edge cooling circuit comprising a downstream cavity extending radially along the intrados wall and the extrados wall and adjacent to the trailing edge, and a second supply cavity fluidly connected to the downstream cavity for its supply with cooling air. Thanks to the fact that the supply of the downstream cavity is indirect, via the second supply cavity, still relatively fresh air, having worked little, can be provided up to the radially outer end of the downstream cavity, which improves the cooling at the trailing edge at the airfoil tip. The fluid connection between the downstream cavity and the second supply cavity can be achieved by a plurality of holes provided over substantially the entire length, in the radial direction, of a wall separating the downstream cavity of the second supply cavity. Such a plurality of holes is sometimes called "calibration".

The present disclosure also relates to a blade for a turbine, comprising a blade root defining a radially inner end of the blade and an airfoil extending radially outwards from the blade root and having an intrados wall and an extrados wall connected to the intrados wall at a leading edge and a trailing edge of the airfoil, the airfoil comprising at least a first internal cooling circuit including at least a first through wall, a second through wall, a third through wall and a fourth through wall, said through walls each extending between the intrados wall and the extrados wall, away from the leading edge and from the trailing edge, at least one inner wall arranged between the intrados wall and the extrados wall and connected to the second through wall and to the third through wall, so as to define a first inner through cavity extending radially along the intrados wall and the extrados wall, between the first through wall and the second through wall, an intrados cavity extending radially along the intrados wall, the inner wall and the second and third through walls, an extrados cavity extending radially along the extrados wall, the inner wall and the second and third through walls, and a second inner through cavity extending radially along the intrados wall and the extrados wall, between the third through wall and the fourth through wall. Such a blade may have all or some of the previously described features.

The present disclosure also relates to a turbomachine comprising a blade as previously described. The term "turbomachine" refers to all the gas turbine apparatuses producing a driving power, among which are distinguished in particular the turbojet engines providing a thrust required for the propulsion by reaction to the high speed ejection of hot gases, and the turbine engines in which the driving power is provided by the rotation of a drive shaft. For example, turbine engines are used as engines for helicopters, ships, trains or as industrial engines. Turboprops (turbine engine driving a propeller) are also turbine engines used as aircraft engine.

SHORT DESCRIPTION OF THE DRAWINGS

The invention and its advantages will be better understood upon reading the following detailed description, of embodiments of the invention given as non-limiting examples. This description refers to the appended drawings, wherein.

Figure 1:
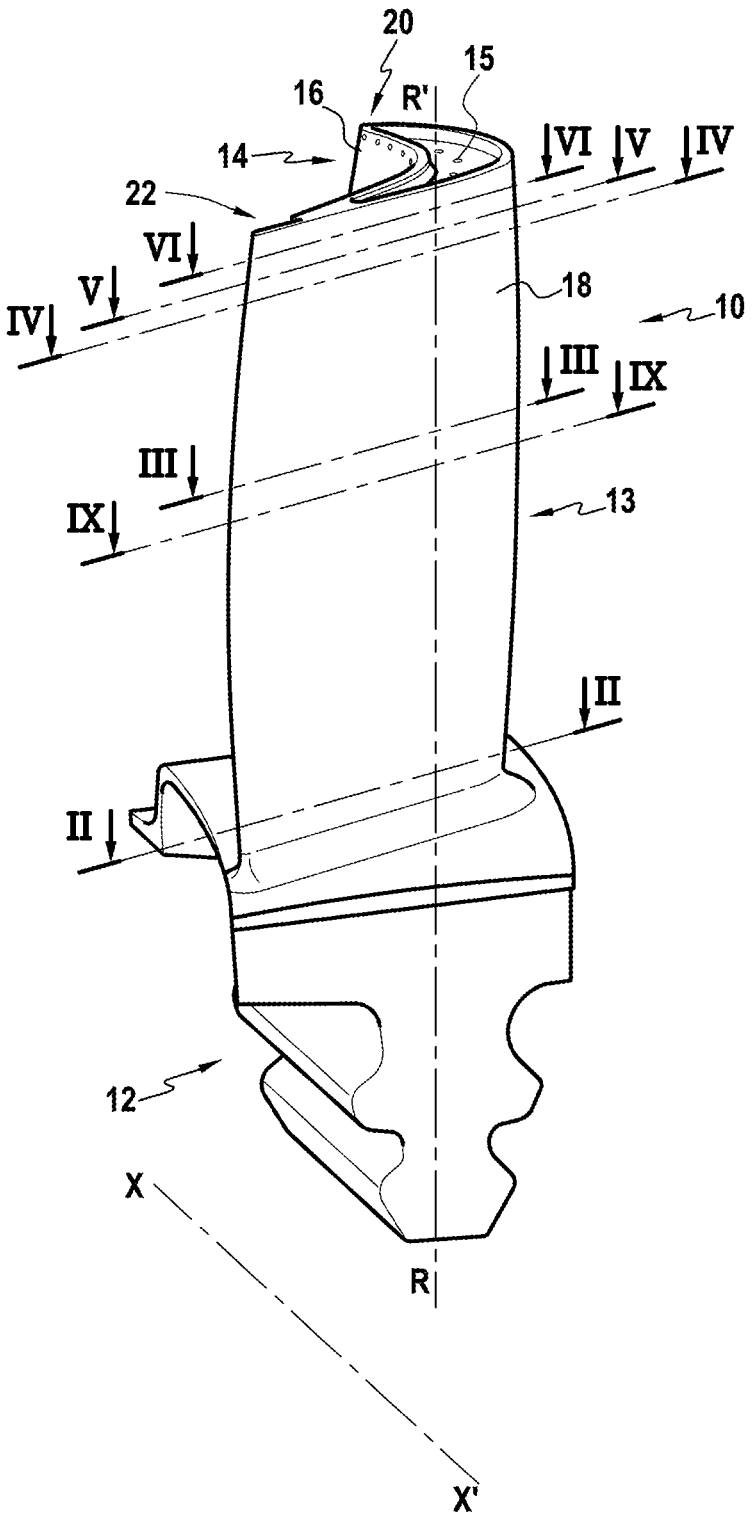
FIG. 1 represents, in perspective, a blade for a turbine according to a first embodiment.
Figure 8:
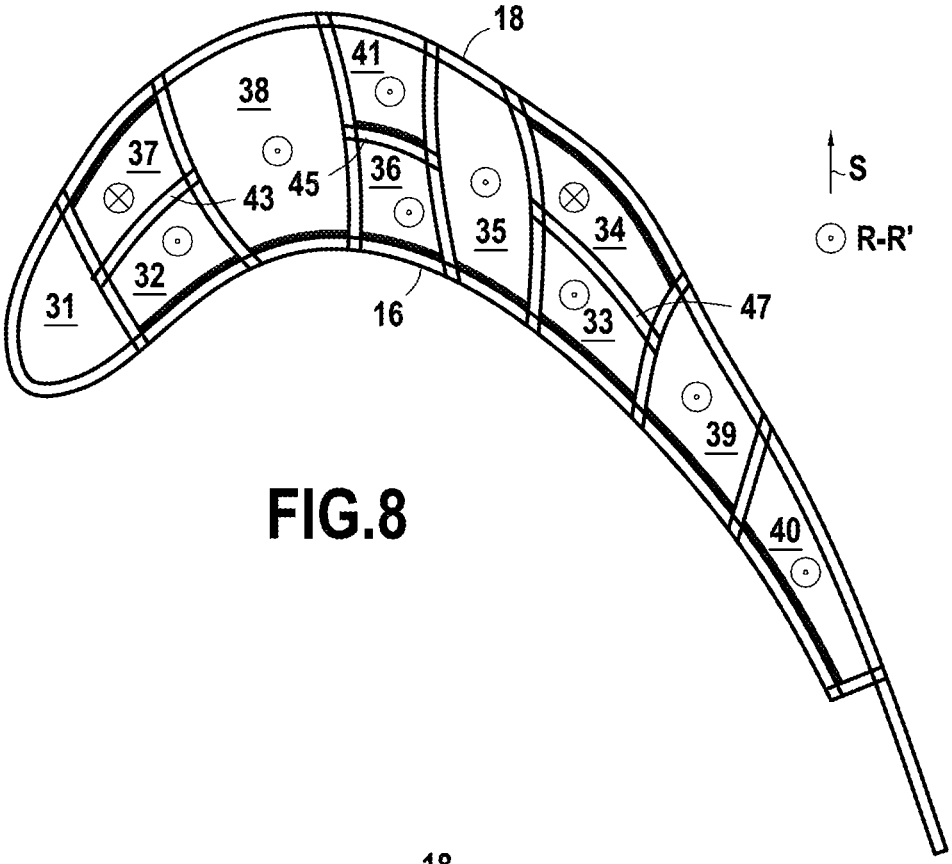
Figure 9:
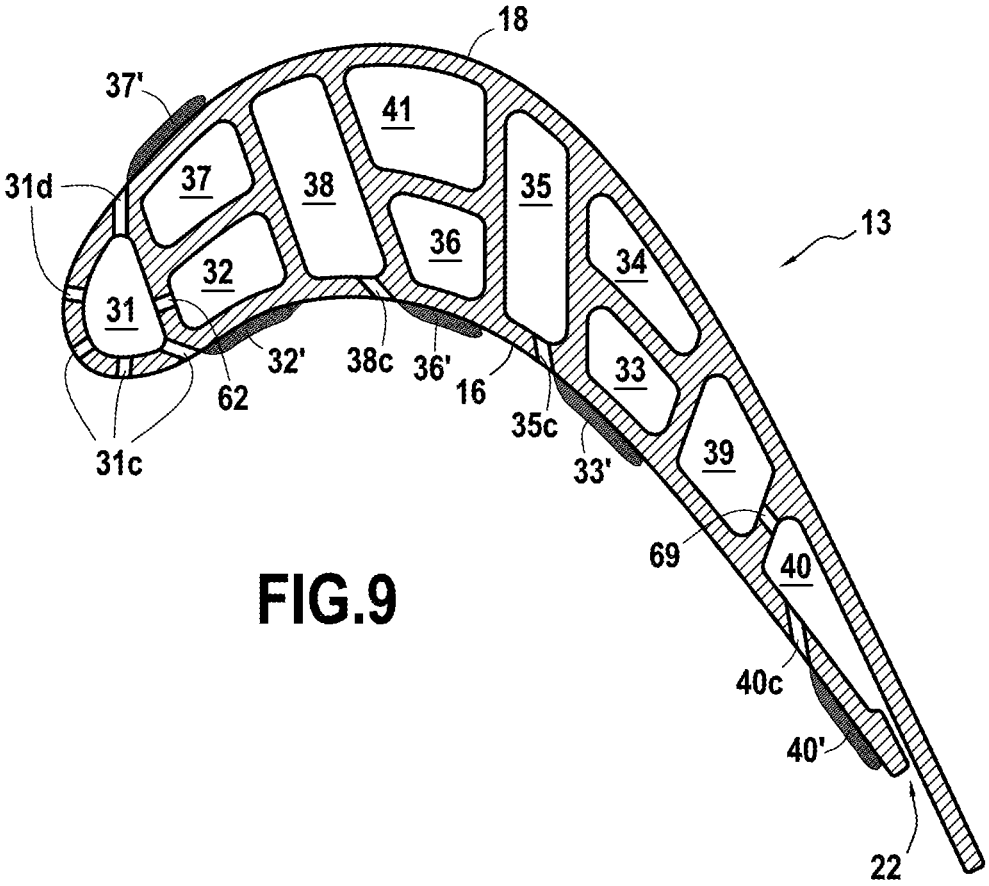
Figure 10:
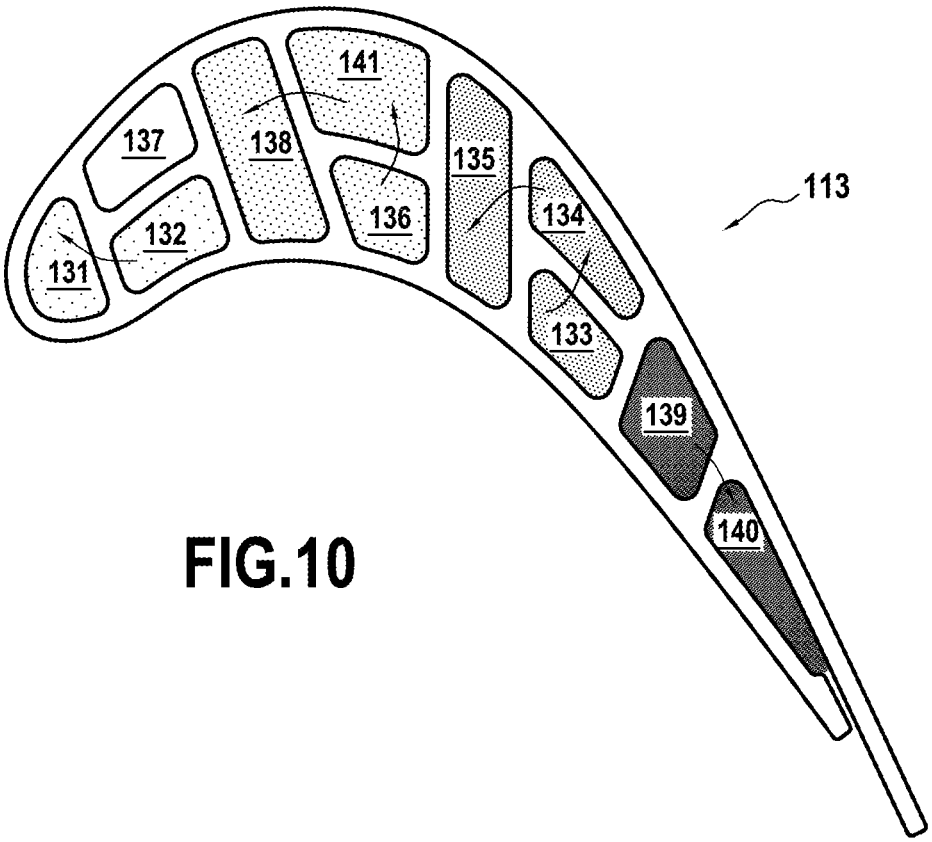
Figure 11:
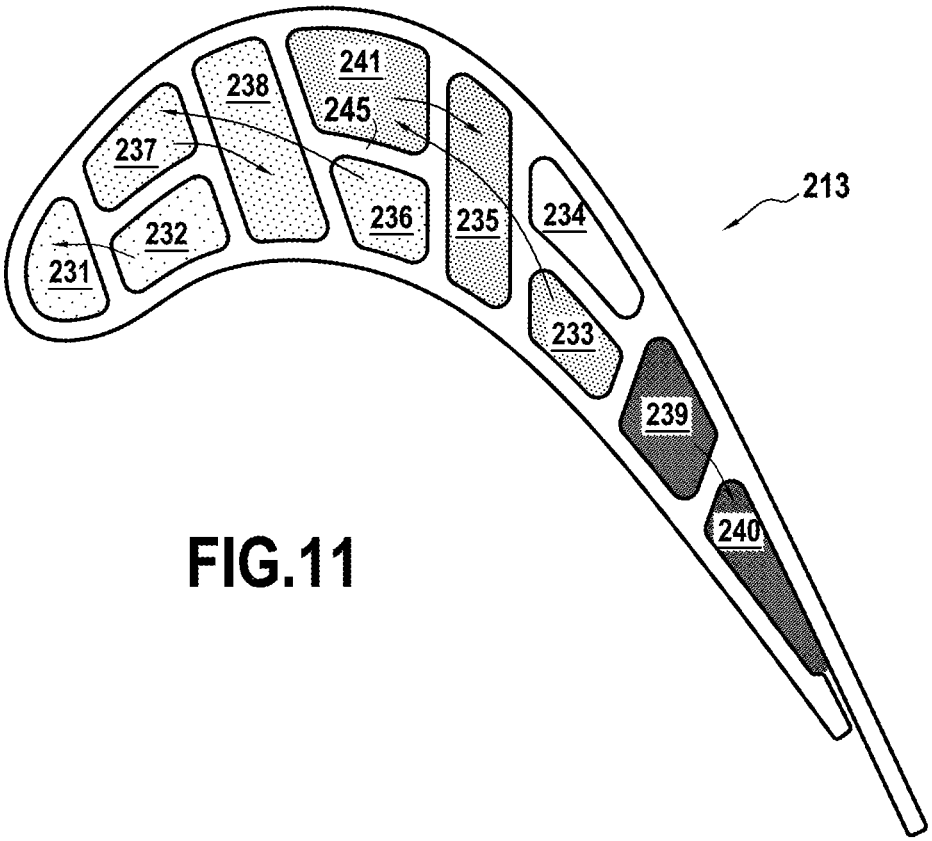
Figure 12:
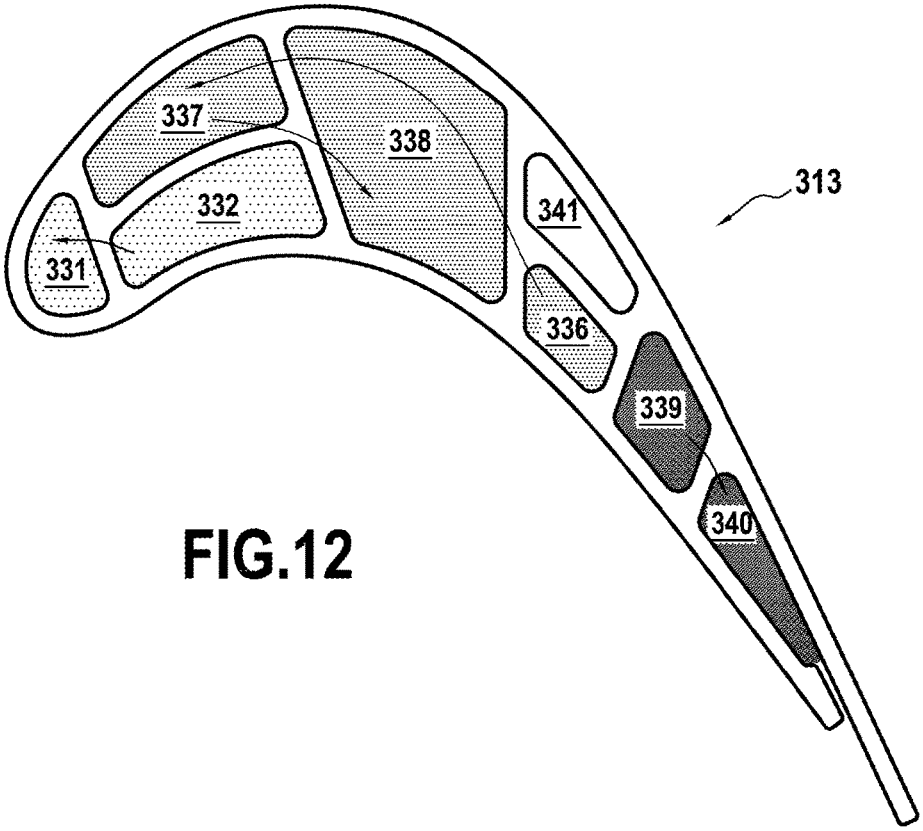
Figure 13:
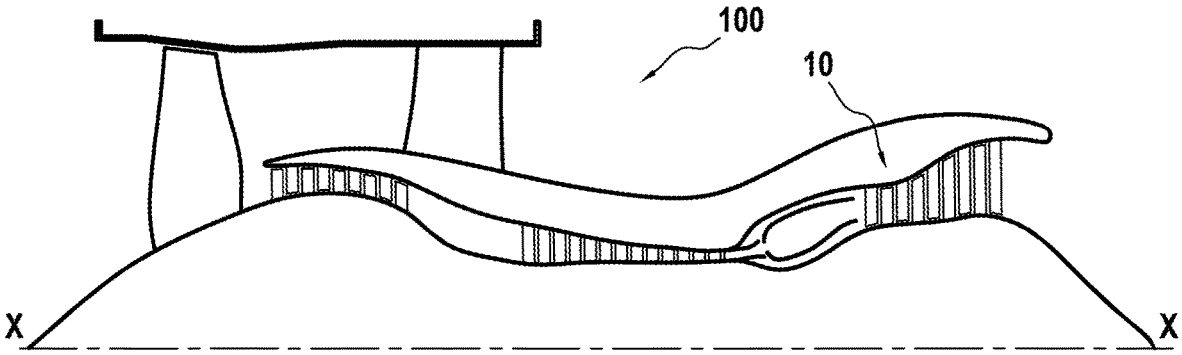

FIG. 8 schematically represents the deformations of the blade according to the first embodiment, in use, in cross-section according to the plane III-III of FIG. 1;

FIG. 9 represents the blade according to the first embodiment in cross-section according to the plane IX-IX of FIG. 1;

FIG. 10 is a diagram synthesizing the flow of a coolant inside a blade according to a second embodiment;

FIG. 11 is a diagram synthesizing the flow of a coolant inside a blade according to a third embodiment;

FIG. 12 is a diagram synthesizing the flow of a coolant inside a blade according to a fourth embodiment;

FIG. 13 is a partial schematic sectional view of a turbomachine incorporating the blade according to one of the embodiments.

DETAILED DESCRIPTION OF THE INVENTION

FIG. 1 represents, in perspective, an example of a hollow rotor blade 10 for a gas turbine, according to a first embodiment. Cooling air (not represented) flows inside the blade from the bottom of the root 12 of the blade into the airfoil 13, along the longitudinal direction R-R' of the airfoil 13 (vertical direction in the figure and radial direction with respect to the axis of rotation X-X' of the rotor), towards the tip 14 of the blade (at the top in FIG. 1), then this cooling air escapes through an outlet to join the main gas stream. The root 12 forms the radially inner end of the blade 10 and the tip 14 forms the radially outer end of the blade 10.

Particularly, this cooling air circulates in an internal cooling circuit which is located inside the airfoil 13 and some branches of which lead to the tip 14 of the blade at through bores 15 provided in a tub.

The body of the airfoil is profiled so that it defines an intrados wall 16 and an extrados wall 18. The intrados wall 16 has a generally concave shape and is the first one appearing facing the hot gas stream that is to say on the pressure side of the gases, through its external face, oriented upstream. The extrados wall 18 is convex and appears subsequently facing the hot gas stream that it is to say on the suction side of the gases, along its external face, oriented downstream.

The intrados 16 and extrados 18 walls join at the location of the leading edge 20 and at the location of the trailing edge 22 which extend radially between the tip 14 of the blade and the top of the root 12 of the blade.

As indicated previously, the airfoil 13 comprises a first internal cooling circuit which will be detailed with reference to FIGS. 2 to 9. Particularly, FIGS. 2 to 6 show successive cross-sections from the radially inner end of the airfoil 13 to its radially outer end.

Figure 3:
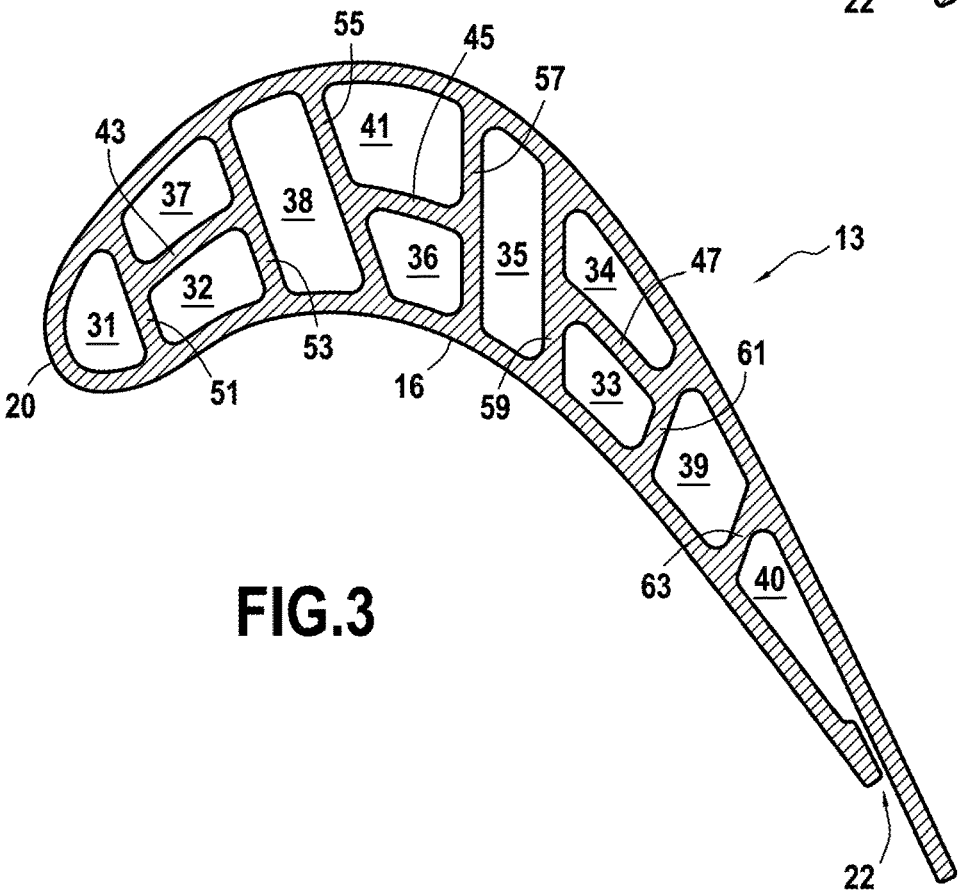
FIG. 3 represents the blade according to the first embodiment in cross-section according to the plane III-III of FIG. 1.

FIG. 3 represents the airfoil 13 in cross-section along a transverse plane. The plane III-III is located preferably between 10% and 90% of the dimension of the airfoil 13 in the longitudinal direction, preferably between 20% and 80%, more preferably between 25% and 75%.

As illustrated in FIG. 3, the blade comprises cavities 31-41 separated from each other by radially extending walls. More particularly, the blade 10 comprises through walls each extending between the intrados wall 16 and the extrados wall 18, at a distance from the leading edge 20 and from the trailing edge 22. In this embodiment, the blade comprises seven through walls 51, 53, 55, 57, 59, 61, 63. As illustrated, the through walls may be substantially rectilinear in cross-section.

Furthermore, the blade 10 comprises inner walls each arranged between the intrados wall 16 and the extrados wall 18 and at a distance from the intrados wall 16 and from the extrados wall 18, in this case three inner walls 43, 45, 47. As illustrated, the inner walls may be substantially rectilinear in cross-section.

The inner walls connect the through walls in pairs so as to form generally H-shaped structures. More specifically, in this embodiment, the inner wall 43 connects the through walls 51 and 53, the inner wall 45 connects the through walls 55 and 57, and the inner wall 47 connects the through walls 59 and 61, whereby three generally H-shaped structures are formed, said three structures being connected to each other only by the intrados and extrados walls 16, 18.

As illustrated in FIG. 3, the aforementioned generally H-shaped structures are separated, in pairs, by an inner through cavity. Thus, in this embodiment, the blade 10 comprises two inner through cavities 35, 38. The inner through cavity 35 (respectively the inner through cavity 38) is defined between two through walls 57, 59 (respectively two through walls 53, 55) belonging to distinct H-structures and extends radially along the intrados wall 16 and the extrados wall 18.

Thus, the intrados wall 16, the extrados wall 18, the inner walls 43, 45, 47 and the through walls 51, 53, 55, 57, 59, 61, 63 define a plurality of cavities of which features and role will now be detailed.

An upstream cavity 31 extends radially along the intrados wall 16 and the extrados wall 18 and is delimited by a through wall 51. The upstream cavity 31 is adjacent to the leading edge 20.

A first supply cavity 32 is defined between the intrados wall 16, the through wall 51, the inner wall 43 and the through wall 53. Insofar as it extends radially along the intrados wall 16 and an inner wall, the first supply cavity 32 may also be called intrados cavity. The first supply cavity 32 is fluidly connected to the upstream cavity 31 for its supply with cooling air, for example by an impact device as previously defined. The first supply cavity 32 may be, for its part, supplied with cooling air via an air inlet section arranged in the blade root 12, for example a channel.

The upstream cavity 31 and the first supply cavity 32 form a leading edge cooling circuit ensuring the cooling of the airfoil 13 at its leading edge 20.

Similarly, a downstream cavity 40 extends radially along the intrados wall 16 and the extrados wall 18 and is delimited by a through wall 63. The downstream cavity 40 is adjacent to the trailing edge 22.

A second supply cavity 39 is defined between the intrados wall 16, the through wall 61, the extrados wall 18 and the through wall 63. The second supply cavity 39 is fluidly connected to the downstream cavity 40 for its supply with cooling air, for example by a calibration as previously defined. The second supply cavity 39 may be, for its part, supplied with cooling air via an air inlet section arranged in the blade root 12, for example a channel.

The downstream cavity 40 and the second supply cavity 39 form a trailing edge cooling circuit ensuring the cooling of the airfoil 13 at its trailing edge 22.

The airfoil 13 further comprises a first internal cooling circuit including at least one intrados cavity, in this case which can be selected from among two intrados cavities 33, 36. The intrados cavity 33 (respectively the intrados cavity 36) extends radially along the intrados wall 16 and an inner wall 47 (respectively an inner wall 45) arranged between the intrados wall 16 and the extrados wall 18. Said inner wall 47 (respectively the inner wall 45) defining the intrados cavity 33 (respectively the intrados cavity 36) can be referred to as first inner wall. Furthermore, the intrados cavity 33 (respectively the intrados cavity 36) is delimited by the through walls 59, 61 (respectively the through walls 55, 57), the first inner wall 47 (respectively the first inner wall 45) being connected to said through walls 59, 61 (respectively to said through walls 55, 57).

The first internal cooling circuit furthermore comprises at least one extrados cavity, in this case which can be selected from among three extrados cavities 37, 41, 34. The extrados cavity 37 (respectively the extrados cavity 41, respectively the extrados cavity 34) extends radially along the extrados wall 18 and an inner wall 43 (respectively an inner wall 45, respectively an inner wall 47) arranged between the intrados wall 16 and the extrados wall 18. Said inner wall 43 (respectively the inner wall 45, respectively the inner wall 47) defining the extrados cavity 37 (respectively the extrados cavity 41, respectively the extrados cavity 34) can be referred to as second inner wall. The second inner wall may be distinct or merged with the first inner wall mentioned above. In the case where the first inner wall and the second inner wall are merged, the corresponding intrados and extrados cavities may be located on either side of said first and second inner walls. For example, it may be the intrados cavity 33, the extrados cavity 34 and the inner wall 47. Conversely, in the case where the first and second inner walls are distinct, the corresponding intrados and extrados cavities are not located on either side of the same inner wall. This example can be illustrated by the intrados cavity 36 defined by the first inner wall 45 and the extrados cavity 37 defined by the second inner wall 43.

Furthermore, the extrados cavity 37 (respectively the extrados cavity 41, respectively the extrados cavity 34) is delimited by the through walls 51, 53 (respectively the through walls 55, 57, respectively the through walls 59, 61), the second inner wall 43 (respectively the second inner wall 45, respectively the second inner wall 47) being connected to said through walls 51, 53 (respectively to said through walls 55, 57, respectively to said through walls 59, 61).

In addition, the first cooling circuit further includes at least one inner through cavity, in this case which can be selected from among three inner through cavities 38, 35, 39. The inner through cavity 38 (respectively 35, respectively 39) is defined between two through walls 51, 53 (respectively 55, 57, respectively 59, 61) and extends radially along the intrados wall 16 and the extrados wall 18.

Thus, in this first embodiment, a first internal cooling circuit can be identified including at least one intrados cavity 33 extending radially along the intrados wall 16 and a first inner wall 47 arranged between the intrados wall 16 and the extrados wall 18, at least one extrados cavity 34 extending radially along the extrados wall 18 and a second inner wall 47 arranged between the intrados wall 16 and the extrados wall 18, and in this case merged with the first inner wall, the first cooling circuit further including at least one inner through cavity 35 defined between two through walls 57, 59 each extending between the intrados wall 16 and the extrados wall 18, at a distance from the leading edge 20 and from the trailing edge 22, the inner through cavity 35 extending radially along the intrados wall 16 and the extrados wall 18. The first inner wall 47 (and consequently the second inner wall) is connected to one of said through walls, namely the through wall 59.

In this embodiment, the airfoil 13 comprises another first internal cooling circuit including at least one intrados cavity 36 extending radially along the intrados wall 16 and a first inner wall 45 arranged between the intrados wall 16 and the extrados wall 18, at least one extrados cavity 37 extending radially along the extrados wall 18 and a second inner wall 43, arranged between the intrados wall 16 and the extrados wall 18, the first cooling circuit further including at least one inner through cavity 38 defined between two through walls 53, 55 each extending between the intrados wall 16 and the extrados wall 18, at a distance from the leading edge 20 and from the trailing edge 22, the inner through cavity 38 extending radially along the intrados wall 16 and the extrados wall 18. The first inner wall 45 and the second inner wall 43 are each connected to one of said through walls, namely respectively connected to the through walls 53, 55.

Figure 2:
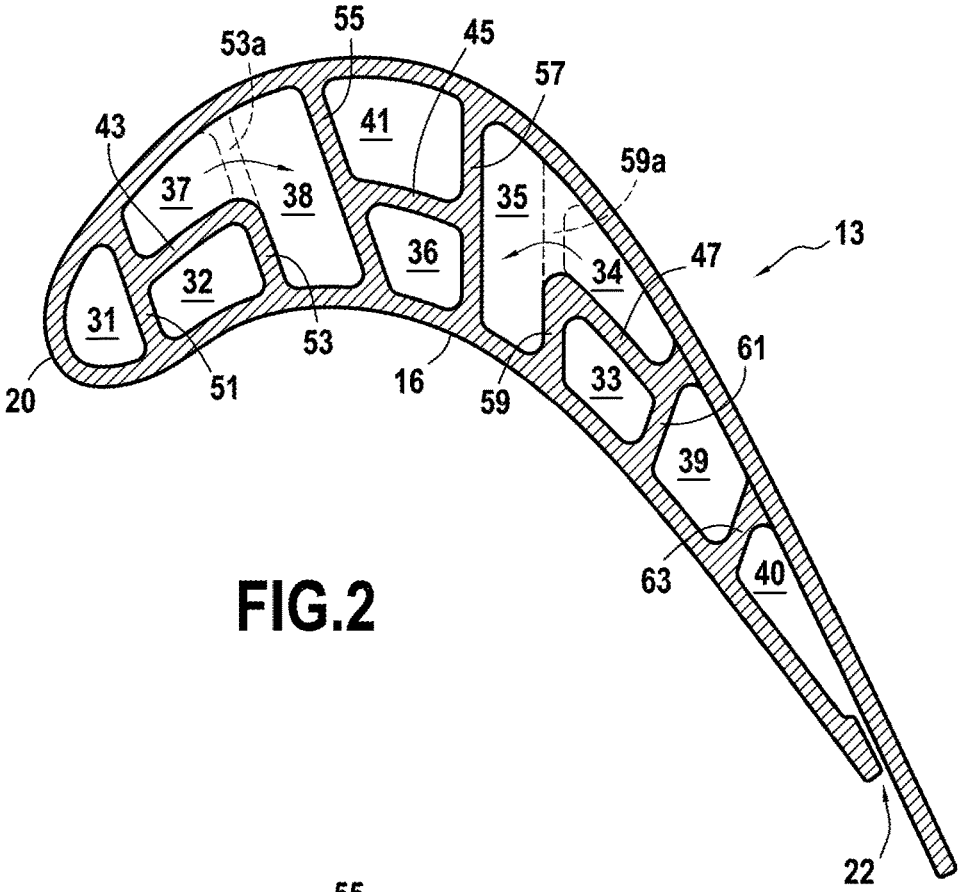
FIG. 2 represents the blade according to the first embodiment in cross-section along the plane II-II of FIG. 1.

FIG. 2 illustrates a section of the airfoil 13 radially further inwards than the section of FIG. 3 (see FIG. 1). As illustrated in FIG. 2, at a radially inner portion of the airfoil, a passage 53*a* is arranged in the through wall 53 so as to fluidly connect the extrados cavity 37 to the inner through cavity 38. Furthermore, a passage 59*a* is arranged in the through wall 59 so as to fluidly connect the extrados cavity 34 to the inner through cavity 35. Thus, the extrados cavity 34 (respectively the extrados cavity 37) and the inner through cavity 35 (respectively the inner through cavity 38) are fluidly connected in series, as illustrated by the arrows representing the passage of fluid from the cavities 34 to 35 (respectively from the cavities 37 to 38).

More generally, a passage 59*a* (respectively a passage 53*a*) is arranged in a radially inner portion of the blade 13 so as to fluidly connect the extrados cavity 34 (respectively the extrados cavity 37) and the inner through cavity 35 (respectively the inner through cavity 38).

Figure 4:
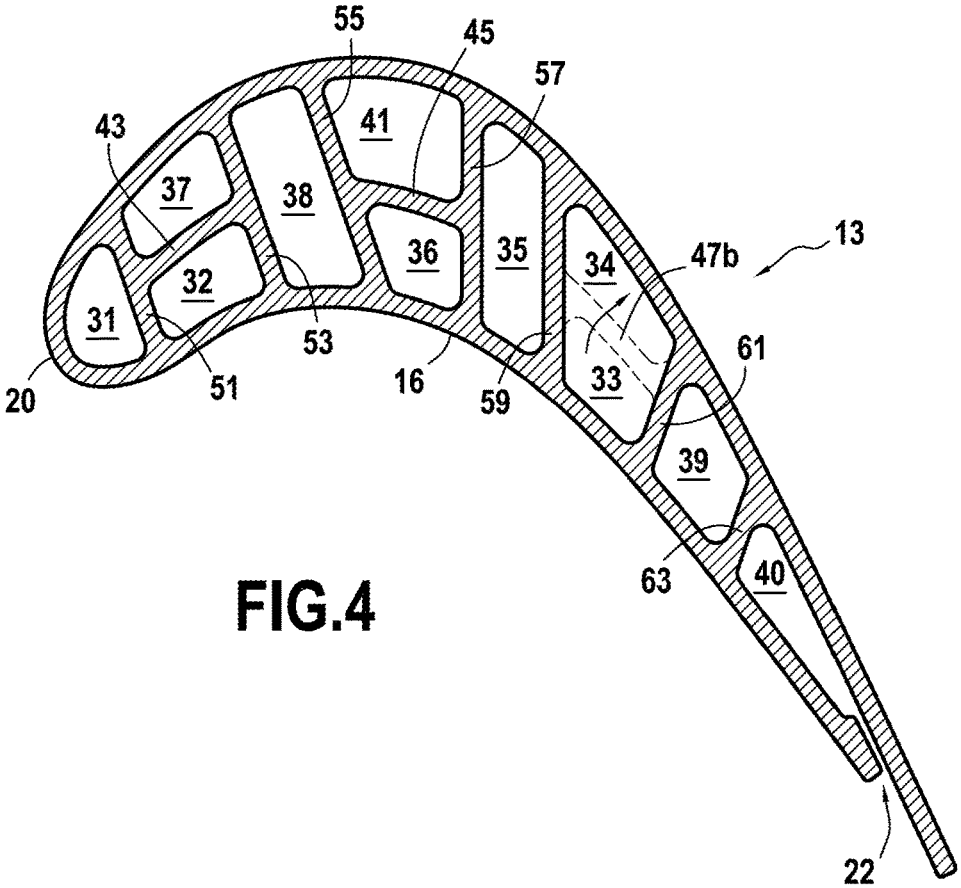
FIG. 4 represents the blade according to the first embodiment in cross-section according to the plane IV-IV of FIG. 1.

FIG. 4 illustrates a section of the airfoil 13 radially further outwards than the section of FIG. 3 (see FIG. 1). As illustrated in FIG. 4, at a radially outer portion of the airfoil, a passage 47*b* is arranged in the inner wall 47 so as to fluidly connect the intrados cavity 33 to the extrados cavity 34. Thus, the intrados cavity 33 and the extrados cavity 34 are fluidly connected in series, as illustrated by the arrow representing the passage of fluid between said cavities. More generally, a passage 47*b* is arranged in a radially outer portion of the airfoil 13 so as to fluidly connect the intrados cavity 33 and the extrados cavity 34.

In view of the above, the intrados cavity 33, the extrados cavity 34 and the inner through cavity 35 are fluidly connected in series, in this order.

Figure 5:
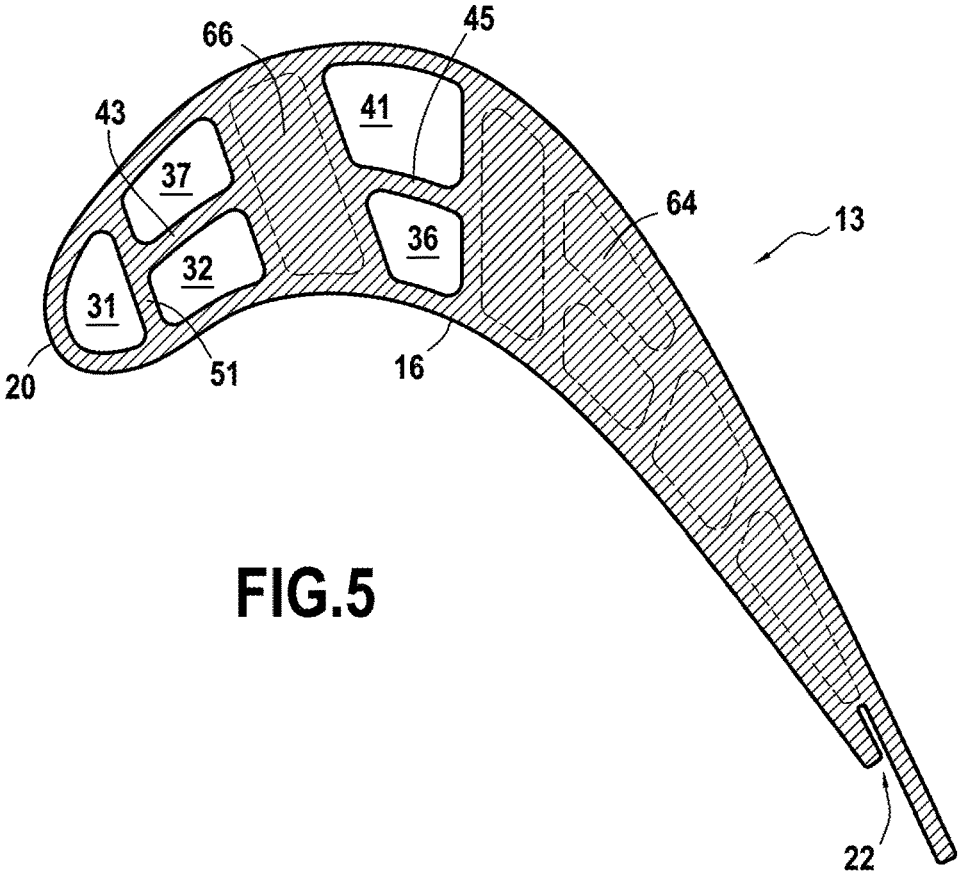
FIG. 5 represents the blade according to the first embodiment in cross-section according to the plane V-V of FIG. 1.

FIG. 5 illustrates a section of the airfoil 13 radially further outwards than the section of FIG. 4 (see FIG. 1). As can be seen in FIG. 5, a bottom wall 64 closes the radially outer end of the intrados cavity 33, of the extrados cavity 34, of the inner through cavity 35, of the second supply cavity 39 and of the downstream cavity 40. Furthermore, a bottom wall 66 closes the radially outer end of the inner through cavity 38. On the other hand, the upstream cavity 31, the first supply cavity 32, the intrados cavity 36, the extrados cavity 37 and the extrados cavity 41 extend radially beyond the bottom walls 64, 66.

Figure 6:
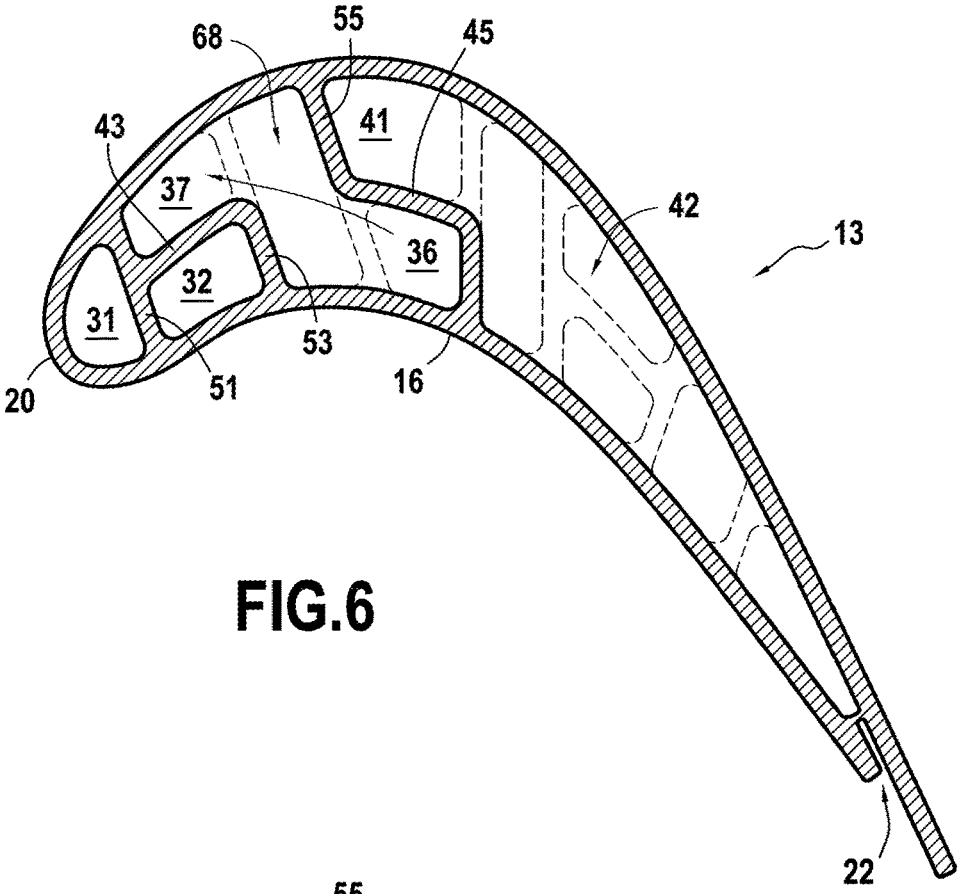
FIG. 6 represents the blade according to the first embodiment in cross-section according to the plane VI-VI of FIG. 1.

FIG. 6 illustrates a section of the airfoil 13 radially further outwards than the section of FIG. 5 (see FIG. 1). As can be seen in FIG. 6, a passage 68 fluidly connects the intrados cavity 36 to the extrados cavity 37 without passing through the inner through cavity 38, thanks to the bottom wall 66. Thus, the intrados cavity 36 and the extrados cavity 37 are fluidly connected in series, as illustrated by the arrow representing the passage of fluid between said cavities. In this case, the passage 68 overhangs the inner through cavity 38. More generally, a passage 68 is arranged in a radially outer portion of the airfoil 13 so as to fluidly connect the intrados cavity 36 and the extrados cavity 37.

In view of the foregoing, the intrados cavity 36, the extrados cavity 37 and the inner through cavity 38 are fluidly connected in series, in that order.

On the other hand, the extrados cavity 41 may serve as an auxiliary extrados cavity for the supply of a cooling cavity 42 of the tub, positioned under the tub in a radial direction. The positioning of the auxiliary extrados cavity 41 on the extrados side, away from the leading edge and from the trailing edge, preferably in an intermediate position between the leading edge 20 and the trailing edge 22, makes it possible to limit the heating of the cooling air during its flow in the auxiliary extrados cavity 41 and to deliver to the cooling cavity 42 of the tub a fluid as cold as possible, for an effective cooling of the tip 14. Because of the bottom wall 64, the cooling cavity 42 is supplied only by the auxiliary extrados cavity 41 and fluidly separated from the intrados cavity 33, from the extrados cavity 34, from the inner through cavity 35, from the second supply cavity 39 and from the downstream cavity 40.

Figure 7:
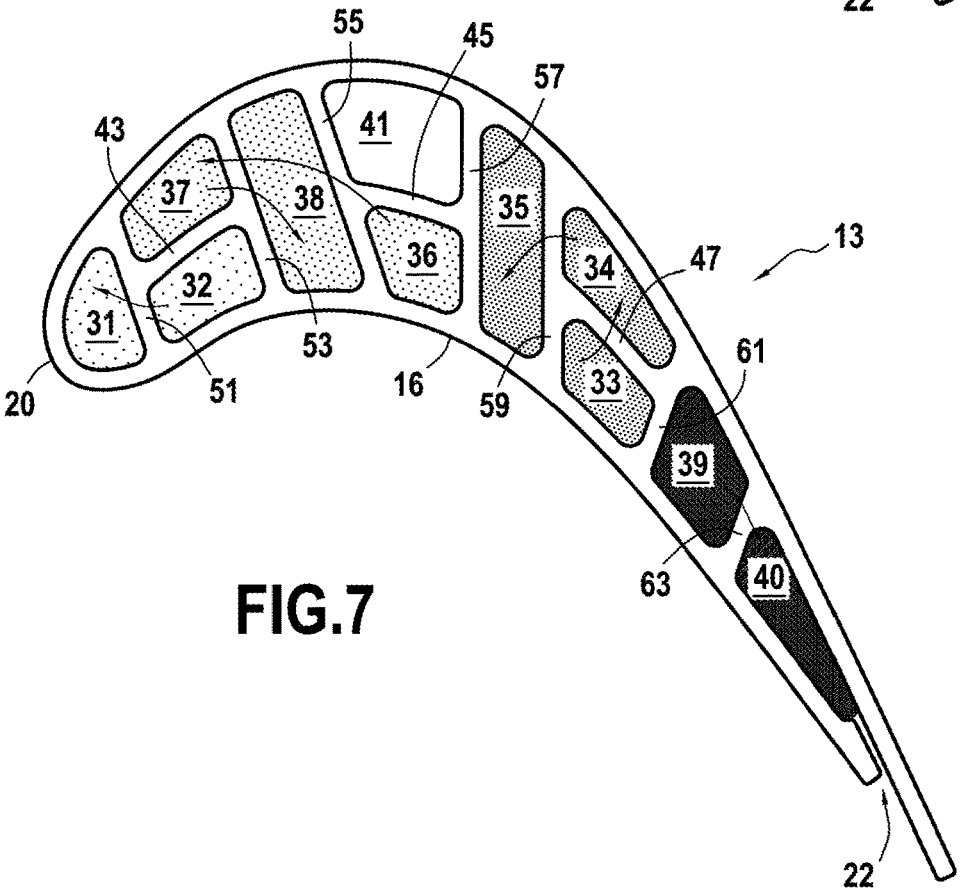
FIG. 7 is a diagram synthesizing the flow of a coolant inside the blade according to the first embodiment.

FIG. 7 schematizes, from the section of FIG. 3, the circulation of the cooling air in the embodiment previously described. The cavities fluidly connected in series together have been represented with identical densities of dots. The arrows indicate a possible direction of circulation of the fluid, this direction being determined according to the following.

In the present embodiment, air inlet sections may be provided in the blade root 12 for the supply of the cooling air cavities. For example, an air inlet section may be provided for at least one or each of the following cavities: the first supply cavity 32, the intrados cavity 33, the intrados cavity 36, the second supply cavity 39, the auxiliary extrados cavity 41.

The direction of circulation of the coolant obtained under these conditions is represented in FIG. 8. As can be seen from FIG. 8, the coolant circulates from the root 12 toward the tip 14 in the supply cavities 32, 39, in the intrados cavities 33, 36, in the inner through cavities 35, 38 and in the downstream cavity 40, and from the tip 14 toward the root 12 in the extrados cavities 34 and 37.

When the rotor on which the blade 10 is mounted rotates in the direction S represented in FIG. 8, the cooling air is further subjected to the Coriolis force. Given the direction of circulation described above, in the supply cavities 32, 39, in the intrados cavities 33, 36, in the inner through cavities 35, 38 and in the downstream cavity 40, the air is pressed against the intrados side of said cavities, which is illustrated in solid lines in FIG. 8. In contrast, in the extrados cavities 34, 37, the air is pressed against the extrados side of said cavities.

Due to this cooling and to the arrangement of the through walls and inner walls, the thermo-mechanical stresses accumulated in the airfoil 13 in operation are greatly reduced. Indeed, FIG. 8 also schematically illustrates the deformations undergone by the structure of the airfoil 13. As can be seen from FIG. 8, the intrados and extrados walls 16, 18 deform further than the inner walls 43, 45, 47, due to their higher temperature in operation. The presence of inner through cavities such as the cavities 35, 38—and to a certain extent the second supply cavity 39 which also meets the definition of an inner through cavity within the meaning of the present disclosure—makes it possible to accommodate this differential expansion and minimize the stresses within the airfoil 13, as can be deduced from the curvature taken by the through walls.

In addition, the presence and the relatively small deformation of the inner walls 43, 45, 47 make it possible to properly support the bottom walls 64, 66, which extend transversely. Indeed, being at a temperature lower than the intrados and extrados walls 16, 18, the inner walls 43, 45, 47 have, all things being equal, better mechanical properties, are stiffer and better withstand the stresses that result from the centrifugal force related to the rotation of the turbine. This recovery of the forces by the inner walls 43, 45, 47 also relieves the intrados and extrados walls 16, 18, of which lifetime increases consequently.

FIG. 9 is substantially identical to FIG. 3, except that the section of the airfoil 13 considered (plane IX-IX in FIG. 1) is selected to show the presence of orifices allowing the circulation of the air within the airfoil 13 and toward the outside of the airfoil 13.

An orifice 62, preferably a plurality of orifices, is arranged in the through wall 51, between the first supply cavity 32 and the upstream cavity 31. The orifice 62 allows supplying the upstream cavity 31 with cooling air indirectly, as previously disclosed.

An orifice 69, preferably a plurality of orifices, is arranged in the through wall 63, between the second supply cavity 39 and the downstream cavity 40. The orifice 69 allows supplying the downstream cavity 40 with cooling air indirectly, as previously disclosed.

Furthermore, discharge orifices such as the orifices 31*c*, 35*c*, 38*c*, 40*c* are provided in the intrados wall 16, opening respectively onto the upstream cavity 31, the inner through cavities 35, 38 and the downstream cavity 40. The discharge orifices 31*c*, 35*c*, 38*c*, 40*c* may be configured to create a protective fluid film on the outer surface of the airfoil 13, downstream of said orifices. To this end, the orifices 31*c*, 35*c*, 38*c*, 40*c* can be oriented towards the trailing edge 22. In this case, said orifices respectively create protective films 32', 33', 36' and 40' respectively protecting the cavities 32, 33, 36, 40.

Similarly, discharge orifices 31*d* may be provided in the extrados wall 18, in particular at the leading edge. In this case, the discharge orifices 31*d* connect the upstream cavity 31 to the outside of the airfoil 13 and allow the creation of a protective fluid film 37' intended to protect the extrados cavity 37.

As seen from FIG. 9, the cavities and the discharge orifices are provided so that a circuit protects itself. For example, the air entering through the intrados cavity 36 circulates towards the extrados cavity 37 and then the inner through cavity 38, and is then discharged through the discharge orifice 38*c* where it contributes to creating the protective fluid film 36' which protects the intrados cavity 36. It is advantageous for this purpose that the air circulates generally in counter-flow in the cavities that is to say from the trailing edge toward the leading edge. It is the case in this example, since the air outlet cavity, namely the inner through cavity 38, is located upstream of the air inlet cavity, namely the intrados cavity 36. The same applies for the leading edge cooling circuit and for the internal cooling circuit formed by the cavities 33-35.

The blade 10 may be manufactured, according to the method known per se, from lost-wax casting. To do so, cores are previously manufactured, which cores occupy the space to be arranged for the cavities during the production of the mold.

The cores corresponding to the cavities 33-35 on the one hand, 36-38 on the other hand can be manufactured according to any suitable method, for example by molding with possible use of inserts in the mold, or by additive manufacturing.

Holding of the cores during the manufacture of the mold can be carried out in a manner known to those skilled in the art. The cores corresponding to the cavities 33-35 on the one hand, 36-38 on the other hand, can be supported by two supports located in the root 12. In order to avoid an excessive number of supports and simplify the arrangement of the root 12 it is possible to provide only one root per core, the holding being completed by a delocalized appendage.

This appendage is preferably provided to form, in the final blade, an opening which is then likely to be resealed by a brazed ball.

After the pouring of the metal and the destruction of the cores, the cavities may undergo a dedusting operation. To do so, it is possible to provide in the airfoil a dedusting hole, for example at the blade tip. If necessary, for the purpose of dedusting the through cavities 35, 38 respectively closed by the bottom walls 64, 66, the shape of the cooling cavity 42 of the tub and/or of the passage 68 may be adapted to allow the passage of a rod secured to the core and the production of the dedusting hole directly from casting, and/or to allow the production of said hole by machining after casting of the airfoil. The dedusting hole can, possibly, also allow the discharge of debris in operation.

FIGS. 10 to 12 present a blade for a turbine in other embodiments. In these figures, the elements corresponding or identical to those of the first embodiment will receive the same reference sign, within the hundreds digits, and will not be described again.

FIGS. 10 to 12 are schematic views similar to that of FIG. 7 and represented according to the same conventions, described above.

In the airfoil 113 according to a second embodiment represented in FIG. 10, the cavity 137 is used as auxiliary extrados cavity. The cavity 141 is used as an extrados cavity fluidly connected in series between the intrados cavity 136 and the inner through cavity 138. The bottom wall 66 described in relation to FIG. 5 can be extended to close the intrados cavity 136 and the extrados cavity 141, given that it is not necessary, in this embodiment, to provide a passage similar to the passage 68 described in relation to FIG. 6.

Thus, in this embodiment, the airfoil comprises a first internal cooling circuit including the intrados cavity 133, the extrados cavity 134 and the inner through cavity 135, and a second internal cooling circuit including the intrados cavity 136, the extrados cavity 141 and the inner through cavity 138. Within the meaning of the present disclosure, the first and second internal cooling circuits of this embodiment are identical. Furthermore, the cavities 131, 132, 139, 140 of the leading edge and trailing edge cooling circuits are unchanged.

This embodiment allows providing a cooling cavity of the tub that is larger than the cooling cavity 42 described above and allows a similar manufacture of the cores of the internal cooling circuits.

In the airfoil 213 according to a third embodiment represented in FIG. 11, the first internal cooling circuit formed by the cavities 236-238 is identical to the first internal cooling circuit according to the first embodiment (cavities 36-38). However, the cavity 234 is used as an auxiliary extrados cavity. The cavity 241 is used as an extrados cavity fluidly connected in series between the intrados cavity 233 and the inner through cavity 235. Consequently, in order to arrange a passage between the intrados cavity 233 and the extrados cavity 241 that does not pass through the inner through cavity 235 (a passage similar to the passage 68 described in relation to FIG. 6), it is necessary, with respect to the first embodiment, to modify the bottom wall 64 described in relation to FIG. 5 so as to allow the intrados cavity 233 and the auxiliary extrados cavity 234 to extend through said bottom wall.

Thus, in this embodiment, the airfoil comprises a first internal cooling circuit including the intrados cavity 233, the extrados cavity 241 and the inner through cavity 235, and a second internal cooling circuit including the intrados cavity 236, the extrados cavity 237 and the inner through cavity 238. Within the meaning of the present disclosure, the first and second internal cooling circuits of this embodiment are identical. In addition, the first inner wall 245 of the first internal cooling circuit is merged with the second inner wall of the second internal cooling circuit.

This embodiment allows merging the air inlet section of the auxiliary extrados cavity 234 with the air inlet section of the second supply cavity 239, which facilitates the arrangement of the airfoil root and its manufacture.

An airfoil 313 according to a fourth embodiment, represented in FIG. 12, is similar to the airfoil 213 according to the third embodiment, except that it comprises only a first internal cooling circuit, formed in this case by the cavities 336, 337 and 338. This embodiment can be advantageously implemented for airfoils of smaller size than those described above. To further reduce the size of the airfoil 313, it would be possible to unify on the one hand the upstream cavity 331 with the first supply cavity 332, and/or on the other hand the downstream cavity 340 with the second supply cavity 339. While the previous embodiments have inner and through walls configured to form a triple H structure, the inner and through walls of the blade 313 according to the fourth embodiment form a double H shape structure. The effects obtained by such a structure and described with respect to the other embodiments are transposed mutatis mutandis.

The blade 10 according to any one of the embodiments described may be a movable blade for a turbine of a turbomachine 100, as represented schematically in FIG. 13.

Although the present invention has been described with reference to specific examples of embodiment, modifications can be made to these examples without departing from the general scope of the invention as defined by the claims. For example, although the flow of fluid in the cavities has been described along a certain direction corresponding to a preferred embodiment, it will be apparent to those skilled in the art that it is possible to change the radial position of the passages between cavities and/or to rearrange the air inlet sections of the blade root so as to impose a direction of circulation of the coolant different from the one described in the present disclosure.

In addition, although the cavities have been represented smooth and empty, it is possible to provide flow disruptors therein in order to increase heat exchanges.

In general, individual features of the various illustrated/mentioned embodiments can be combined in additional embodiments. Consequently, the description and drawings should be considered in an illustrative rather than restrictive sense

The invention claimed is:

1. A blade for a turbine, comprising a blade root defining a radially inner end of the blade and an airfoil extending radially outwards from the blade root and having an intrados wall and an extrados wall connected to the intrados wall at a leading edge and a trailing edge of the airfoil, the airfoil comprising at least a first internal cooling circuit including at least one intrados cavity extending radially along the intrados wall and along a first inner wall arranged between the intrados wall and the extrados wall, and at least one extrados cavity extending radially along the extrados wall and along a second inner wall arranged between the intrados wall and the extrados wall, wherein the first internal cooling circuit further includes at least one inner through cavity defined between two through walls each extending between the intrados wall and the extrados wall, the at least one inner through cavity extending radially along the intrados wall and the extrados wall, wherein the at least one intrados cavity, the at least one extrados cavity and the at least one inner through cavity are fluidly connected in series, and wherein the at least one intrados cavity and the at least one extrados cavity are arranged on either side of the at least one inner through cavity and a passage fluidly connects the at least one intrados cavity to the at least one extrados cavity without passing through the at least one inner through cavity.

2. The blade according to claim 1, wherein the at least one intrados cavity, the at least one extrados cavity and the at least one inner through cavity are fluidly connected in series in this order.

3. The blade according to claim 1, wherein the first inner wall is connected to a first one of said through walls and the second inner wall is connected to a second one of said through walls.

4. The blade according to claim 1, further comprising a third through wall connected to the first inner wall or to the second inner wall, the internal cooling circuit further including a second through cavity extending radially along the intrados wall, the extrados wall and the third through wall.

5. The blade according to claim 1, wherein the intrados cavity is arranged on the trailing edge side and the extrados cavity is arranged on the leading edge side with respect to the inner through cavity.

6. The blade according to claim 1, wherein the first inner wall and the second inner wall are each delimited by two through walls, each through wall extending between the intrados wall and the extrados wall.

7. The blade according to claim 1, wherein the intrados wall has at least one orifice connecting the at least one inner through cavity to the outside of the airfoil.

8. The blade according to claim 1, wherein the airfoil further comprises a second internal cooling circuit identical to the first internal cooling circuit.

9. The blade according to claim 1, further comprising a tub at a radially outer end, and wherein the first internal cooling circuit further includes an auxiliary extrados cavity extending radially along the extrados wall and configured to supply a cooling cavity of the tub.

10. A turbomachine comprising a blade according to claim 1.

11. The blade according to claim 8, wherein the first inner wall of the first internal cooling circuit is merged with the second inner wall of the second internal cooling circuit.

12. A blade for a turbine, comprising a blade root defining a radially inner end of the blade and an airfoil extending radially outwards from the blade root and having an intrados wall and an extrados wall connected to the intrados wall at a leading edge and a trailing edge of the airfoil, the airfoil comprising at least a first internal cooling circuit including at least one intrados cavity extending radially along the intrados wall and along a first inner wall arranged between the intrados wall and the extrados wall, and at least one extrados cavity extending radially along the extrados wall and along a second inner wall arranged between the intrados wall and the extrados wall, wherein the first internal cooling circuit further includes at least one inner through cavity defined between two through walls each extending between the intrados wall and the extrados wall, the at least one inner through cavity extending radially along the intrados wall and the extrados wall, wherein the at least one intrados cavity, the at least one extrados cavity and the at least one inner through cavity are fluidly connected in series, wherein the first inner wall and the second inner wall are distinct and each delimited by two through walls, each through wall extending between the intrados wall and the extrados wall.

* * * * *